US012208340B1

(12) United States Patent
Chen

(10) Patent No.: US 12,208,340 B1
(45) Date of Patent: Jan. 28, 2025

(54) TOY CAR AND TOY CAR SYSTEM

(71) Applicant: Zewei Chen, Guangdong (CN)

(72) Inventor: Zewei Chen, Guangdong (CN)

( * ) Notice: Subject to any disclaimer, the term of this patent is extended or adjusted under 35 U.S.C. 154(b) by 0 days.

(21) Appl. No.: 18/408,178

(22) Filed: Jan. 9, 2024

(30) Foreign Application Priority Data

Nov. 27, 2023 (CN) ..... 202323218728.5

(51) Int. Cl.
*A63H 17/26* (2006.01)
*A63H 18/02* (2006.01)
*A63H 18/08* (2006.01)

(52) U.S. Cl.
CPC ..... *A63H 17/262* (2013.01); *A63H 18/02* (2013.01); *A63H 18/08* (2013.01)

(58) Field of Classification Search
CPC ..... A63H 17/00; A63H 17/26; A63H 17/262; A63H 18/02; A63H 18/08
USPC ..... 446/444, 445, 446, 447, 465, 468, 469; 238/10 R, 10 E, 10 F
See application file for complete search history.

(56) References Cited

U.S. PATENT DOCUMENTS 2,651,882 A * 9/1953 Core ..... A63H 17/38 446/451
2,920,420 A * 1/1960 Koloziejski ..... A63H 18/12 238/10 F
3,139,237 A * 6/1964 Braverman ..... A63H 18/12 104/111
3,159,109 A * 12/1964 Braverman ..... A63H 18/12 310/154.37
3,209,491 A * 10/1965 Roeper ..... A63H 18/028 238/10 R
3,482,351 A * 12/1969 Rix ..... A63H 17/262 446/468
3,540,153 A * 11/1970 Aoki ..... A63H 18/08 105/29.2
3,624,961 A * 12/1971 Brubaker ..... A63H 17/38 446/468
3,694,958 A * 10/1972 Parker ..... A63H 17/262 29/522.1
4,357,877 A * 11/1982 Mariol ..... A63H 19/00 104/243
4,537,577 A * 8/1985 Sansome ..... A63H 18/08 104/248
4,673,182 A * 6/1987 Bowen ..... A63F 9/14 104/53
4,861,306 A * 8/1989 Bolli ..... A63H 18/08 446/96
4,940,443 A * 7/1990 Hesse ..... A63H 18/02 446/431
5,980,358 A * 11/1999 Diller ..... A63H 19/22 105/29.2
6,095,892 A * 8/2000 Moe ..... A63H 17/21 446/431

(Continued)

*Primary Examiner* — Alexander R Niconovich

(57) ABSTRACT

A toy car includes a shell component. The shell component is provided with wheels capable of rotating relative to the shell component. Each of the wheels includes a rolling part and an abutting part. The abutting part is arranged on one side of the rolling part facing away from the shell component. The rolling part is configured to be engaged to an upper surface of a building block and roll along the upper surface of the building block. And the abutting part is configured to abut against a side surface of the building block.

20 Claims, 16 Drawing Sheets

(56) References Cited

U.S. PATENT DOCUMENTS

| | | | | |
|---|---|---|---|---|
| 6,626,116 | B2 * | 9/2003 | Clark, Jr. | A63H 17/262 238/10 F |
| 6,648,723 | B2 * | 11/2003 | Clark, Jr. | A63H 18/12 446/471 |
| 7,517,272 | B2 * | 4/2009 | Bedford | A63H 21/04 446/444 |
| 7,644,664 | B2 * | 1/2010 | Nakao | B61B 13/04 104/243 |
| 7,677,181 | B2 * | 3/2010 | Boyl-Davis | B23Q 9/0042 238/10 R |
| 7,770,524 | B1 * | 8/2010 | Wa | A63H 18/08 105/29.2 |
| 7,938,068 | B2 * | 5/2011 | Parker | A63H 19/34 104/53 |
| 8,069,793 | B2 * | 12/2011 | Rice | A63H 19/10 105/29.2 |
| 9,220,991 | B2 * | 12/2015 | Gastle | B62K 9/00 |
| 9,221,470 | B2 * | 12/2015 | Gastle | A63H 18/02 |
| 10,195,537 | B2 * | 2/2019 | Yakos | A63H 29/22 |
| 11,117,064 | B2 * | 9/2021 | Choi | A63H 18/026 |
| 11,179,649 | B2 * | 11/2021 | Wang | A63H 18/16 |
| 2007/0066180 | A1 * | 3/2007 | Marietta | A63H 17/00 446/56 |
| 2018/0333649 | A1 * | 11/2018 | Mucaro | A63H 17/26 |

* cited by examiner

TOY CAR AND TOY CAR SYSTEM

CROSS-REFERENCE TO RELATED APPLICATIONS

The application claims priority of Chinese patent application CN2023232187285, filed on Nov. 27, 2023, which is incorporated herein by reference in its entireties.

BACKGROUND

People have played various toys more or less since they were young. Playing with toys can exercise the hand-eye coordination, develop the intelligence, and stimulate the enthusiasm. Male and female, old and young, all particularly like playing with toys. Among various toys, toy cars particularly have a wider range of audience.

At present, most of the existing toy cars on the market are toy cars with tracks and toy cars without tracks. The toy cars with the tracks are usually used only if they have matching toy tracks, which greatly limits the usage of toy car products. Once the toy car or one of the toy tracks is damaged, a user has to buy another entire set of product for cooperative use.

For this purpose, the present disclosure provides a toy car that can effectively solve the above-mentioned problems. The toy car can be used in conjunction with an existing building block product, without the need for an additional matching track.

SUMMARY

In order to overcome the shortcomings of the prior art, the present disclosure provides a toy car, which can be used in conjunction with an existing building block product, without the need for an additional matching track.

The technical solution adopted by the present disclosure to solve the technical problem is as follows:

A toy car, includes:

a shell component, wherein the shell component is provided with wheels capable of rotating relative to the shell component;

wherein each of the wheels includes a rolling part and an abutting part; the abutting part is arranged on one side of the rolling part facing away from the shell component; the rolling part is configured to be engaged to an upper surface of a building block and roll along the upper surface of the building block; and the abutting part is configured to abut against a side surface of the building block.

As the improvement of the present disclosure, a surface of the rolling part is provided with a friction pattern, and the friction pattern is configured to be engaged to the upper surface of the building block in a rubbing manner to push the toy car to move.

As the improvement of the present disclosure, a surface of the rolling part is a smooth plane to reduce a friction force between the rolling part and the upper surface of the building block.

As the improvement of the present disclosure, a surface of the rolling part is further provided with a rubber ring, and the rubber ring is engaged to the upper surface of the building block in a rubbing manner to push the toy car to move.

As the improvement of the present disclosure, the rolling part is provided with a first magnetic suction member; the first magnetic suction member is configured to generate a magnetic suction force with a second magnetic suction member inside the building block to make a surface of the rolling part tightly abut against the upper surface of the building block; the wheels are arranged opposite to each other in pairs; a distance between the abutting parts of two of the opposite wheels is configured to be matched with a width of the building block, with a range of 7.5 CM to 7.8 CM; and a distance between the rolling parts of two of the opposite wheels ranges from 5.5 CM to 7.5 CM.

As the improvement of the present disclosure, the toy car further includes a driving device, wherein the shell component is provided with an accommodating chamber; the driving device is arranged in the accommodating chamber; the driving device drives the wheels to rotate; the shell component includes a car head body shell and a car body shell; the car head shell is rotatably connected to the car body shell; the car head shell is provided with a first connecting part; the car body shell is provided with a second connecting part; and the first connecting part is detachably connected to the second connecting part.

As the improvement of the present disclosure, the toy car further includes a bearing component, wherein two ends of the bearing component are connected to the wheels; a bottom of the shell component is provided with a limiting slot; the bearing component is rotatably connected to the shell component; and the limiting slot is configured to allow the bearing component to rotate for use.

As the improvement of the present disclosure, the bearing component includes a connecting shaft and a connecting shaft shell; the connecting shaft is rotatably arranged on the connecting shaft shell; two ends of the connecting shaft are connected to the wheels; the rotating shaft shell is provided with a rotating part; a bottom of the car head shell is provided with a rotating hole; and the rotating part is rotatably inserted into the rotating hole.

As the improvement of the present disclosure, the limiting slot is further covered with a limiting plate connected to the bottom of the shell component, and the limiting plate limits the bearing component in the limiting slot.

As the improvement of the present disclosure, a width of the limiting slot gradually increases from a middle part towards two ends, and the bearing component is rotatably connected to the middle part.

As the improvement of the present disclosure, the limiting slot includes two slot side walls arranged at an angle, and the angle between the two slot side walls ranges from 5 degrees to 60 degrees.

The present disclosure also provides a toy car system, including:

a building block, wherein the building block has an upper surface and a side surface; and a toy car, wherein the toy car includes a shell component and wheels arranged on the shell component and capable of rotating relative to the shell component;

wherein each of the wheels includes a rolling part and an abutting part; the abutting part is arranged on one side of the rolling part facing away from the shell component; the rolling part is engaged to the upper surface of the building block and rolls along the upper surface of the building block; and the abutting part abuts against the side surface of the building block.

As the improvement of the present disclosure, a surface of the rolling part is provided with a friction pattern, and the friction pattern is engaged to the upper surface of the building block in a rubbing manner to push the toy car to move, wherein the upper surface of the building block is a plane.

As the improvement of the present disclosure, a surface of the rolling part is a smooth plane to reduce a friction force between the rolling part and the upper surface of the building block.

As the improvement of the present disclosure, a surface of the rolling part is further provided with a rubber ring, and the rubber ring is engaged to the upper surface of the building block in a rubbing manner to push the toy car to move.

As the improvement of the present disclosure, the rolling part is provided with a first magnetic suction member; a second magnetic suction member is arranged in the building block; a magnetic suction force is generated between the first magnetic suction member and the second magnetic suction member, so that a surface of the rolling part tightly abuts against the upper surface of the building block; the wheels are arranged opposite to each other in pairs; a distance between the abutting parts of two of the opposite wheels is matched with a width of the building block, with a range of 7.5 CM to 7.8 CM; a distance between the rolling parts of two of the opposite wheels ranges from 5.5 CM to 7.5 CM; the shell component includes a car head body shell and a car body shell; the car head shell is rotatably connected to the car body shell; the car head shell is provided with a first connecting part; the car body shell is provided with a second connecting part; and the first connecting part is detachably connected to the second connecting part.

As the improvement of the present disclosure, the toy car system further includes a bearing component, wherein two ends of the bearing component are connected to the wheels; a bottom of the shell component is provided with a limiting slot; the bearing component is rotatably connected to the shell component; and the limiting slot is configured to allow the bearing component to rotate for use.

As the improvement of the present disclosure, the bearing component includes a connecting shaft and a connecting shaft shell; the connecting shaft is rotatably arranged on the connecting shaft shell; two ends of the connecting shaft are connected to the wheels; the rotating shaft shell is provided with a rotating part; a bottom of the car head shell is provided with a rotating hole; and the rotating part is rotatably inserted into the rotating hole.

As the improvement of the present disclosure, the limiting slot is further covered with a limiting plate connected to the bottom of the shell component, and the limiting plate limits the bearing component in the limiting slot.

As the improvement of the present disclosure, a width of the limiting slot gradually increases from a middle part towards two ends, and the bearing component is rotatably connected to the middle part; the limiting slot includes two slot side walls arranged at an angle; and the angle between the two slot side walls ranges from 5 degrees to 60 degrees.

Beneficial effects of the present disclosure are as follows: By the arrangement of the above structure, during use, the toy car is placed on the building block, so that the rolling part of the wheel is combined with the upper surface of the building block, and the abutting part of the wheel abuts against the side surface of the building block. When the toy car moves, the abutting part of the wheel always abuts against the side surface of the building block, so that the toy car can travel along an arrangement and extension direction of the building block. The rolling part provides power for the toy car to move forward through a friction force, and the abutting part can always limit the toy car, so that the toy car runs more stably.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
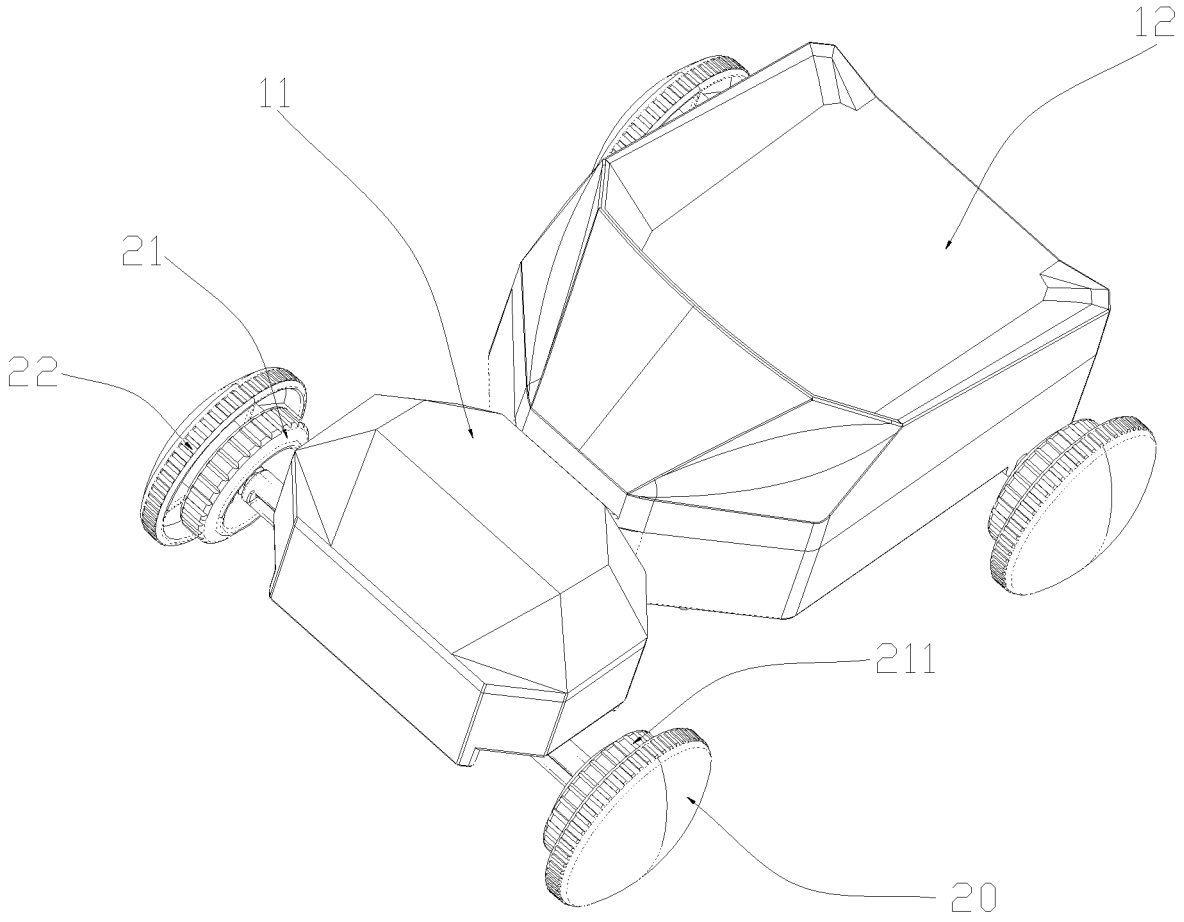
FIG. 1 is a schematic diagram of an entire structure of an angle of a first state according to the present disclosure.
Figure 2:
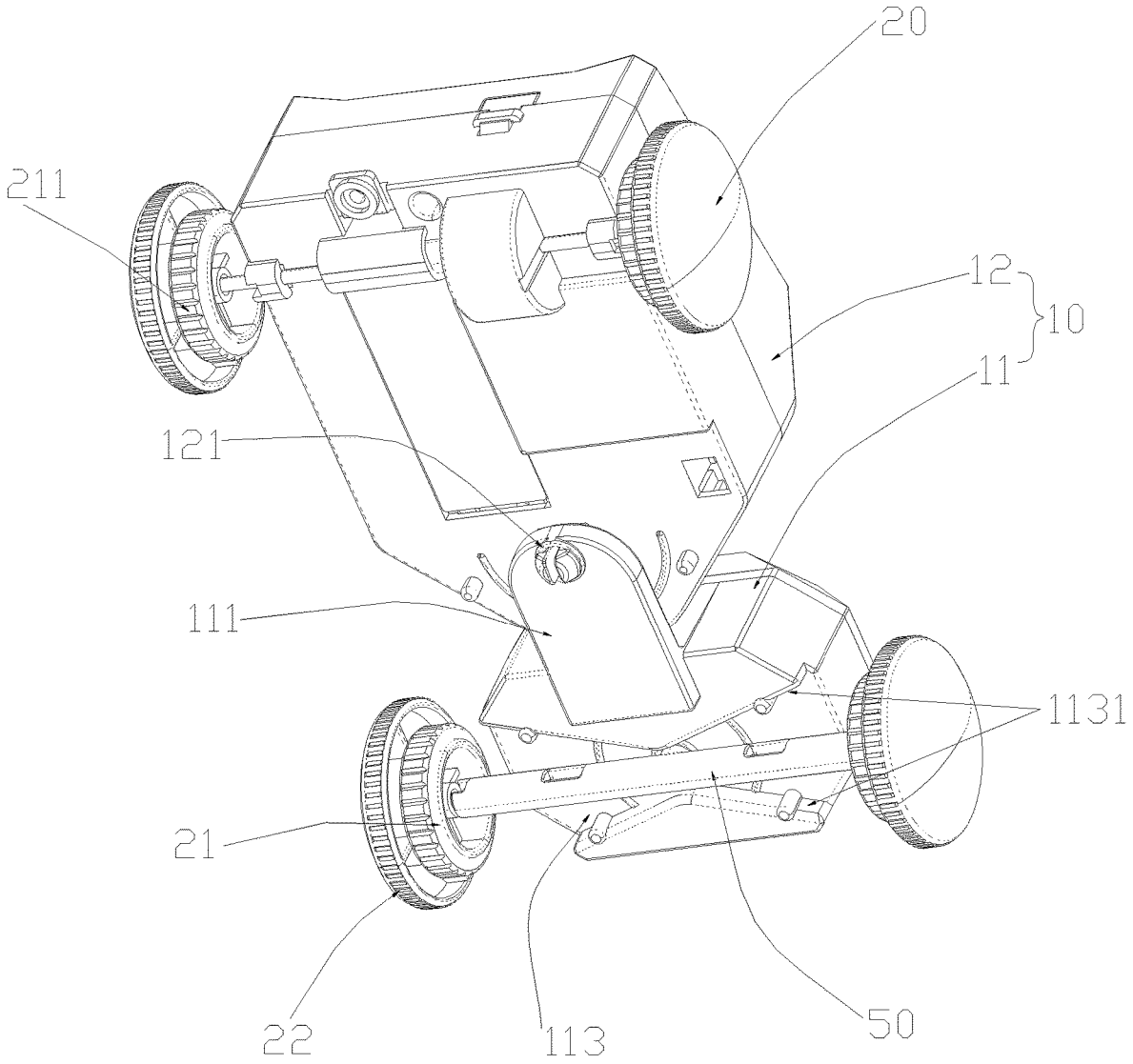
FIG. 2 is a schematic diagram of an entire structure of another angle of a first state according to the present disclosure.
Figure 3:
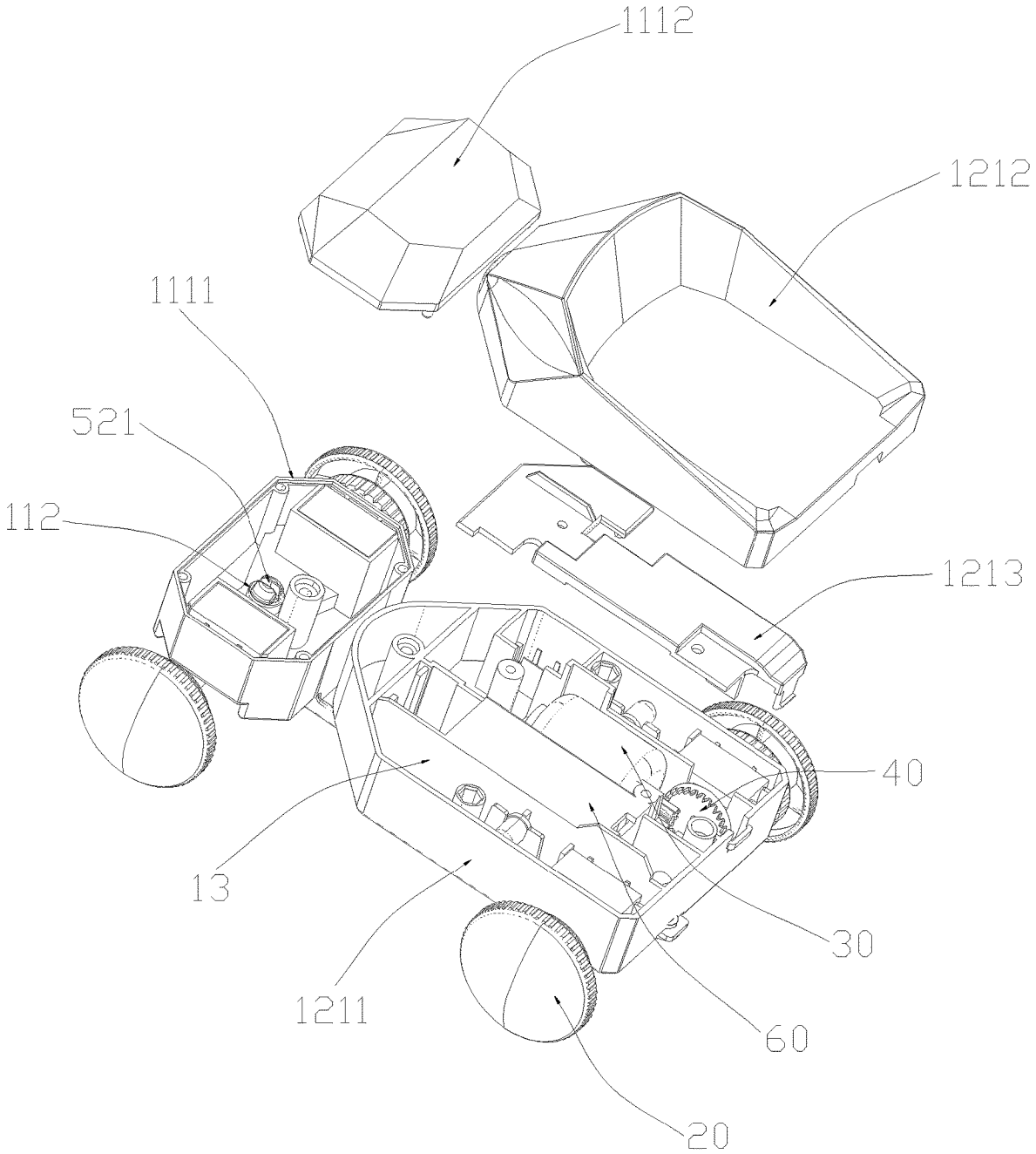
FIG. 3 is a schematic diagram of an exploded structure according to the present disclosure.
Figure 4:
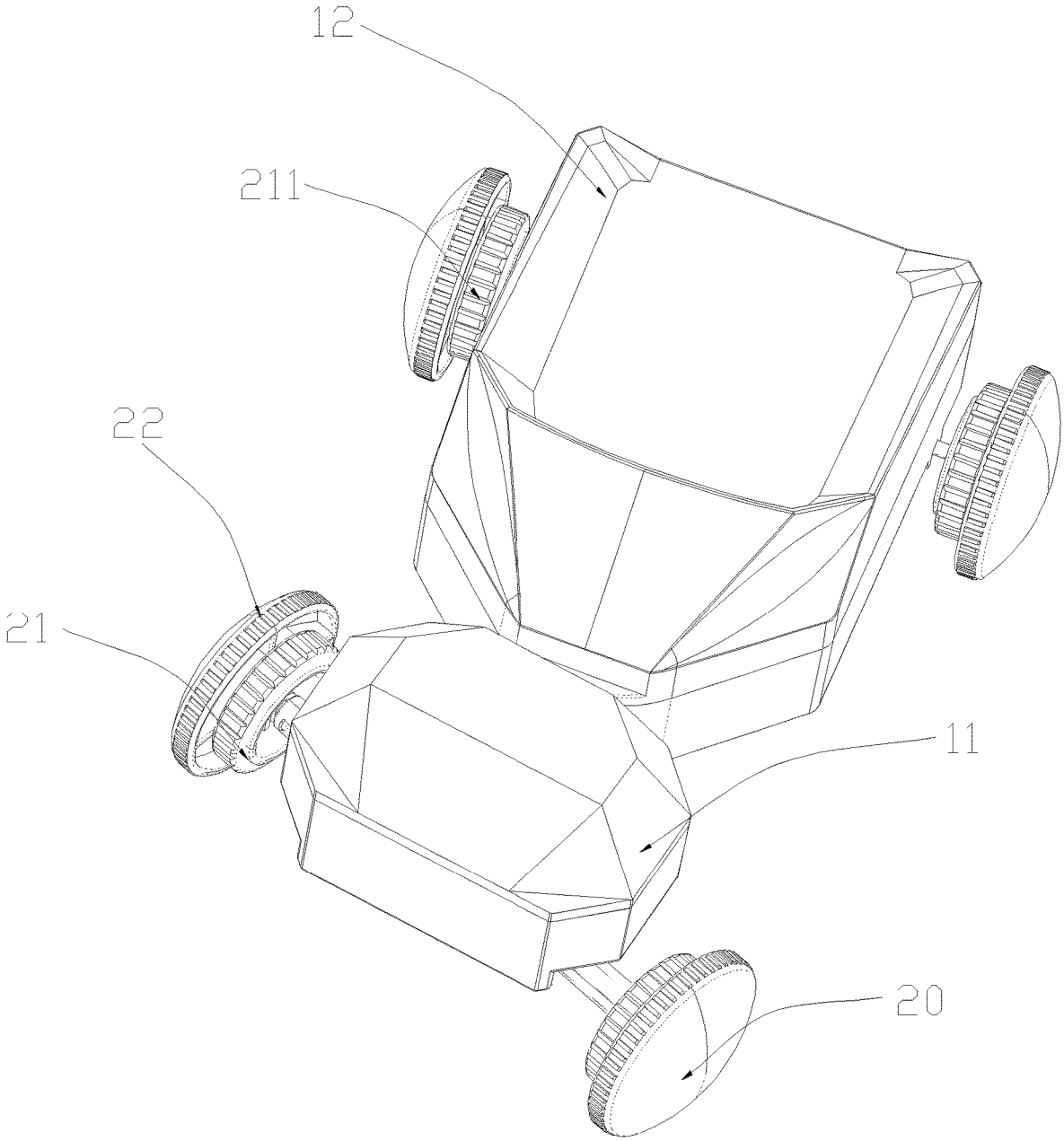
FIG. 4 is a schematic diagram of an entire structure of an angle of a second state according to the present disclosure.
Figure 5:
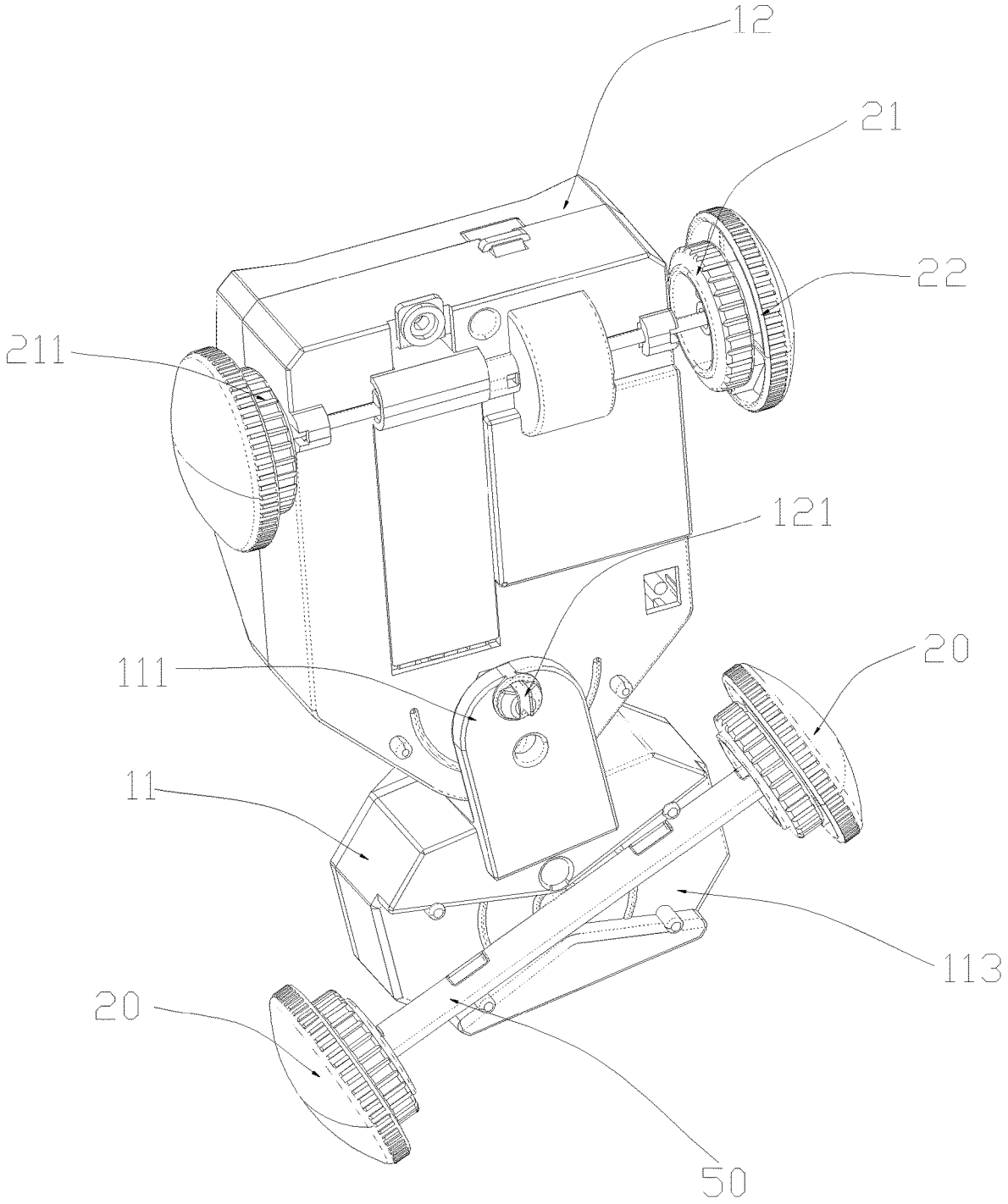
FIG. 5 is a schematic diagram of an entire structure of an angle of a second state according to the present disclosure.
Figure 6:
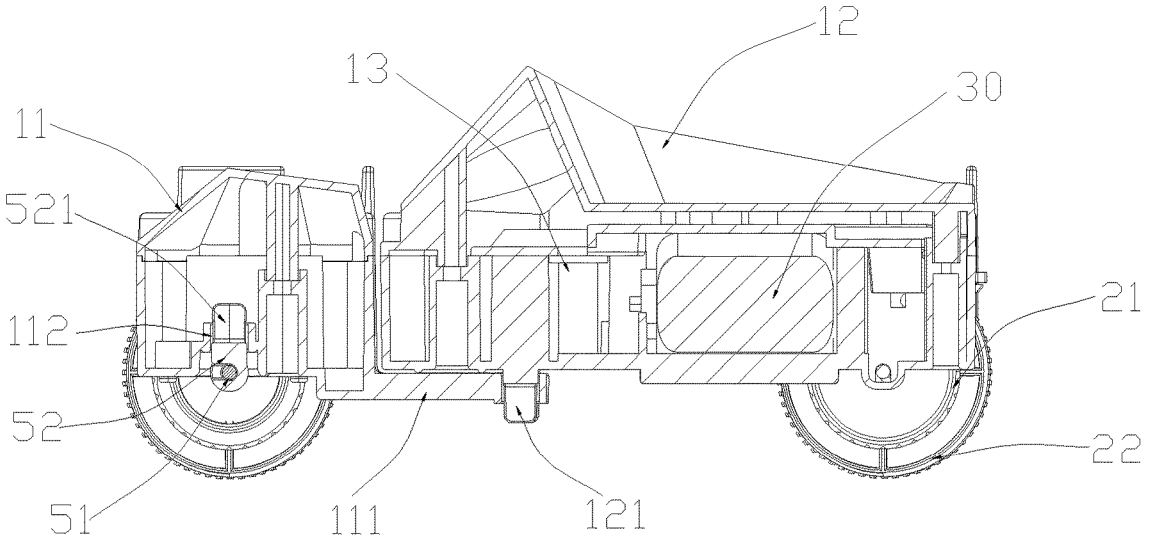
FIG. 6 is a cross-sectional view of the present disclosure.
Figure 7:
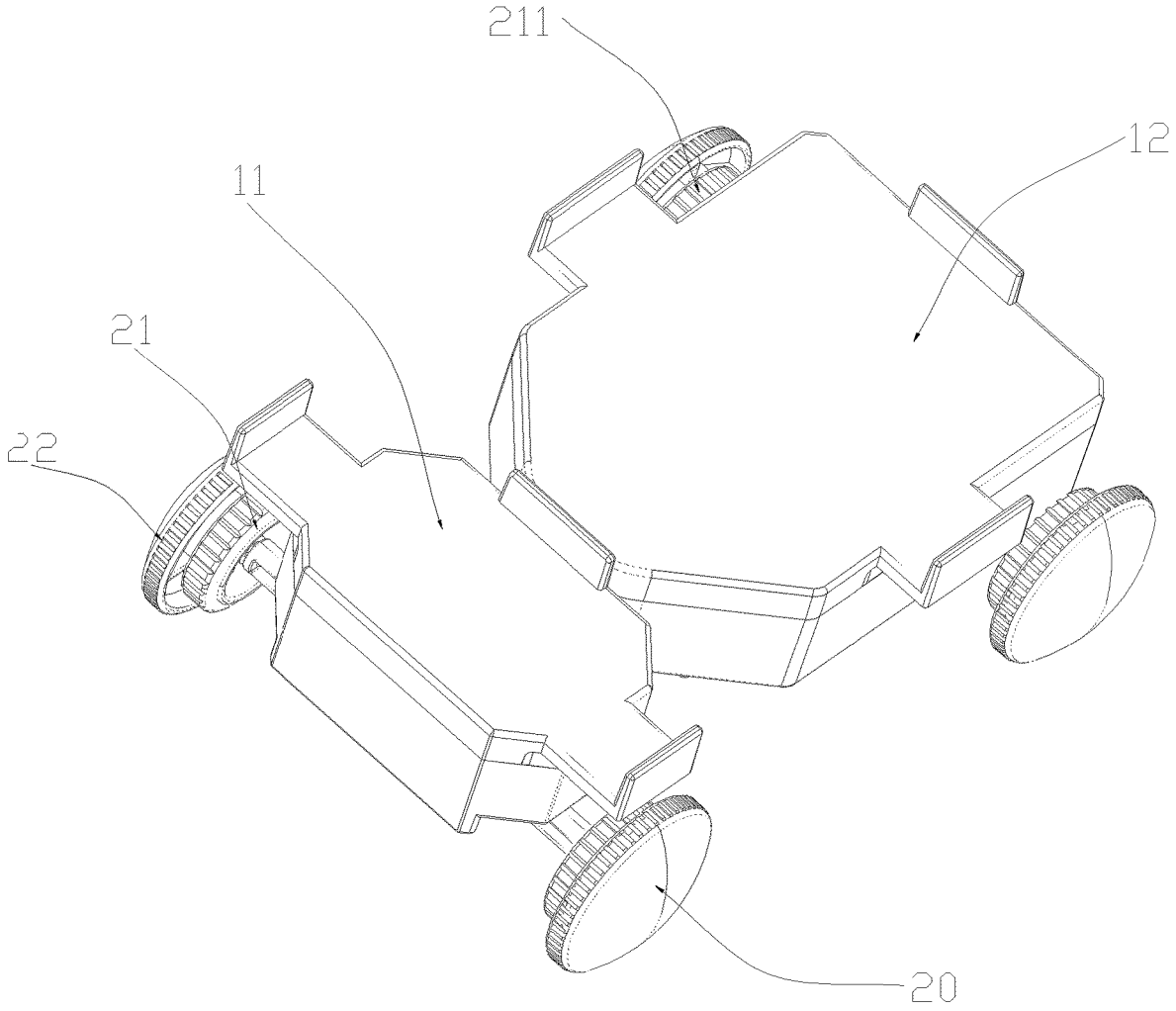
FIG. 7 is a schematic diagram of an entire structure according to another implementation of the present disclosure.
Figure 8:
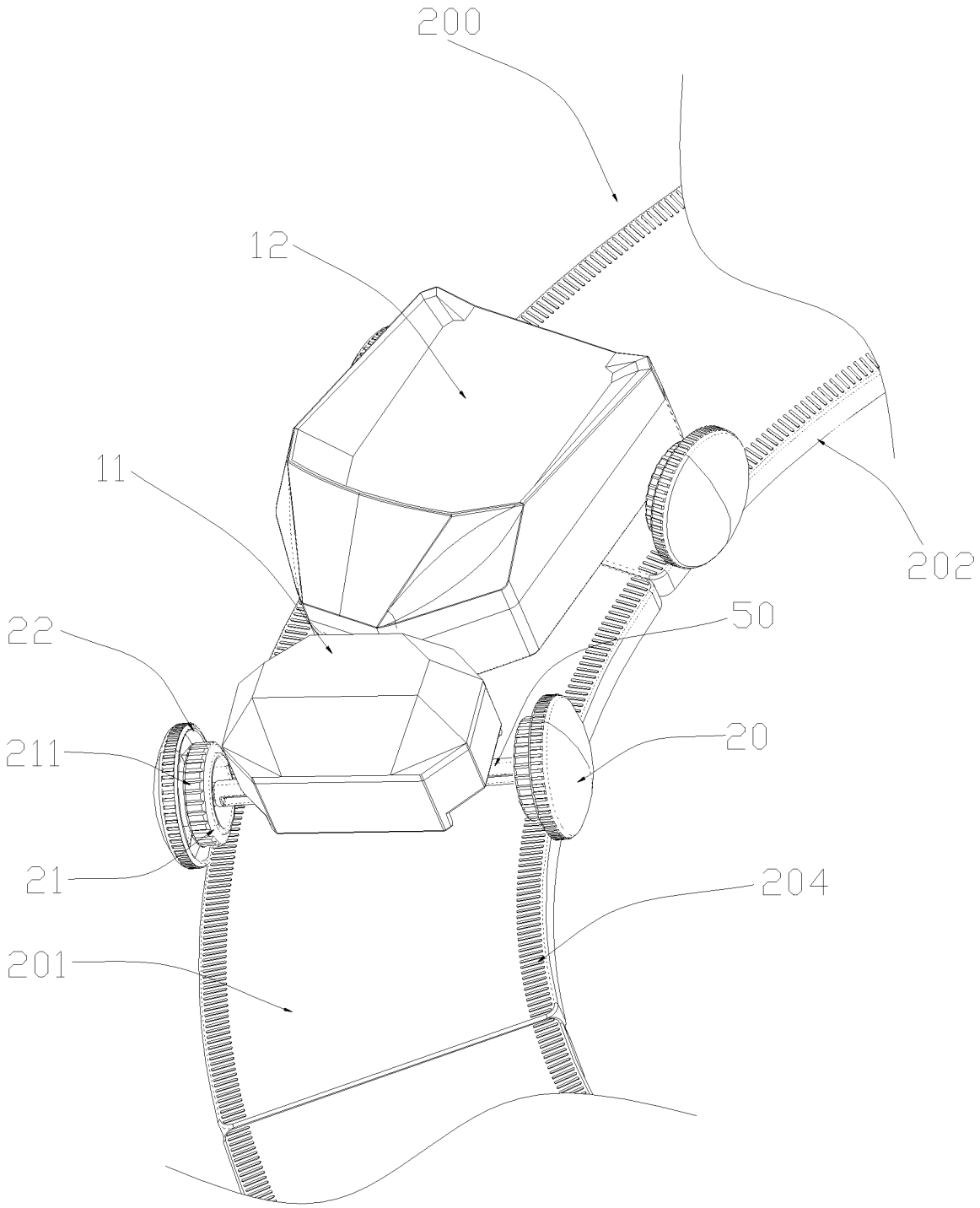
FIG. 8 is a schematic diagram of an entire structure of a first angle of cooperation between a toy car and a building block according to the present disclosure.
Figure 9:
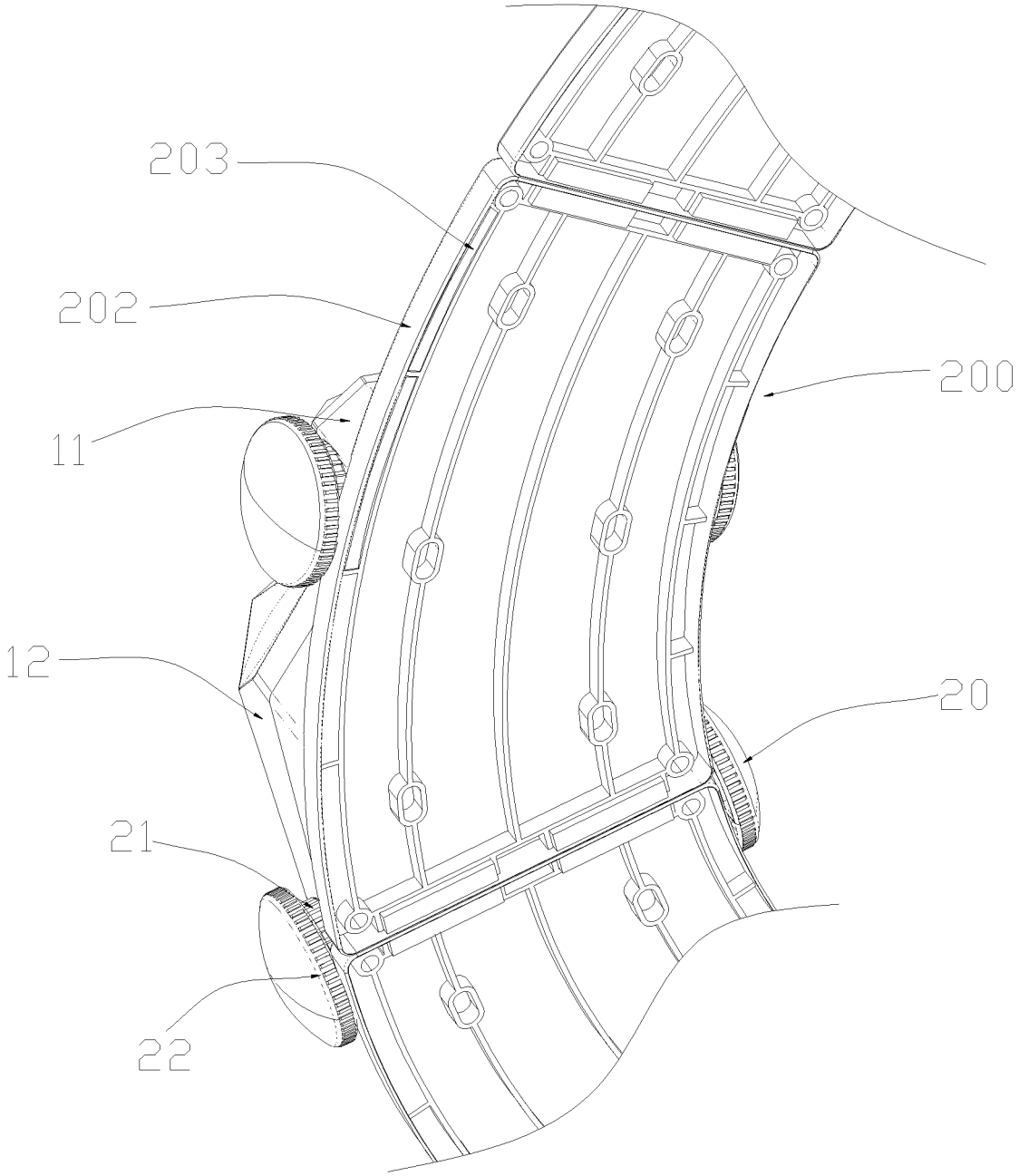
FIG. 9 is a schematic diagram of an entire structure of a second angle of cooperation between a toy car and a building block according to the present disclosure.
Figure 10:
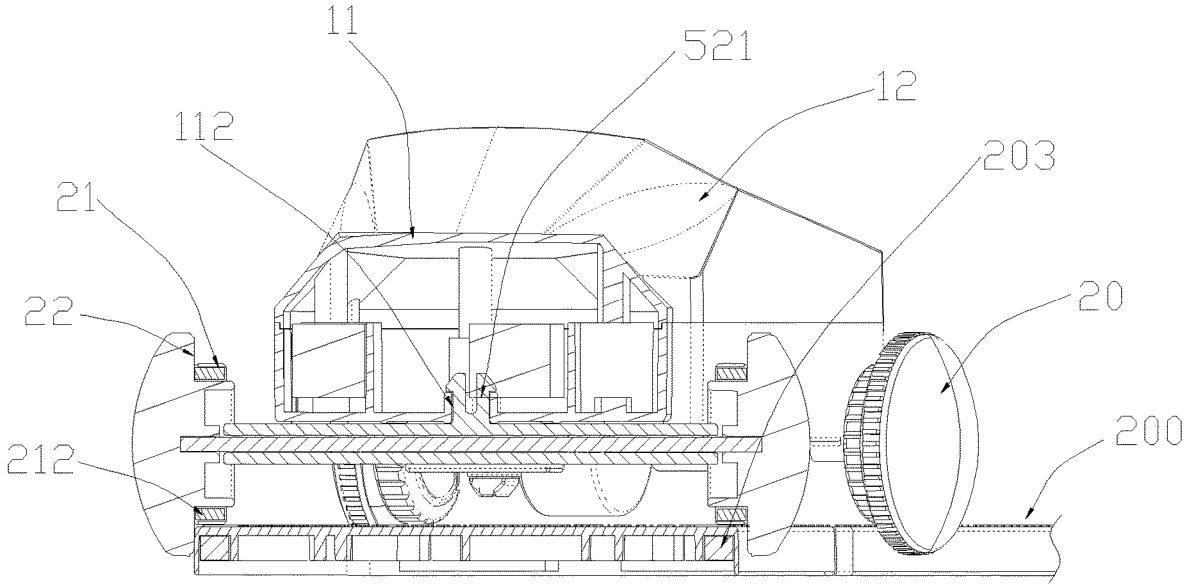
FIG. 10 is cross-sectional view of cooperation between a toy car and a building block according to the present disclosure.
Figure 11:
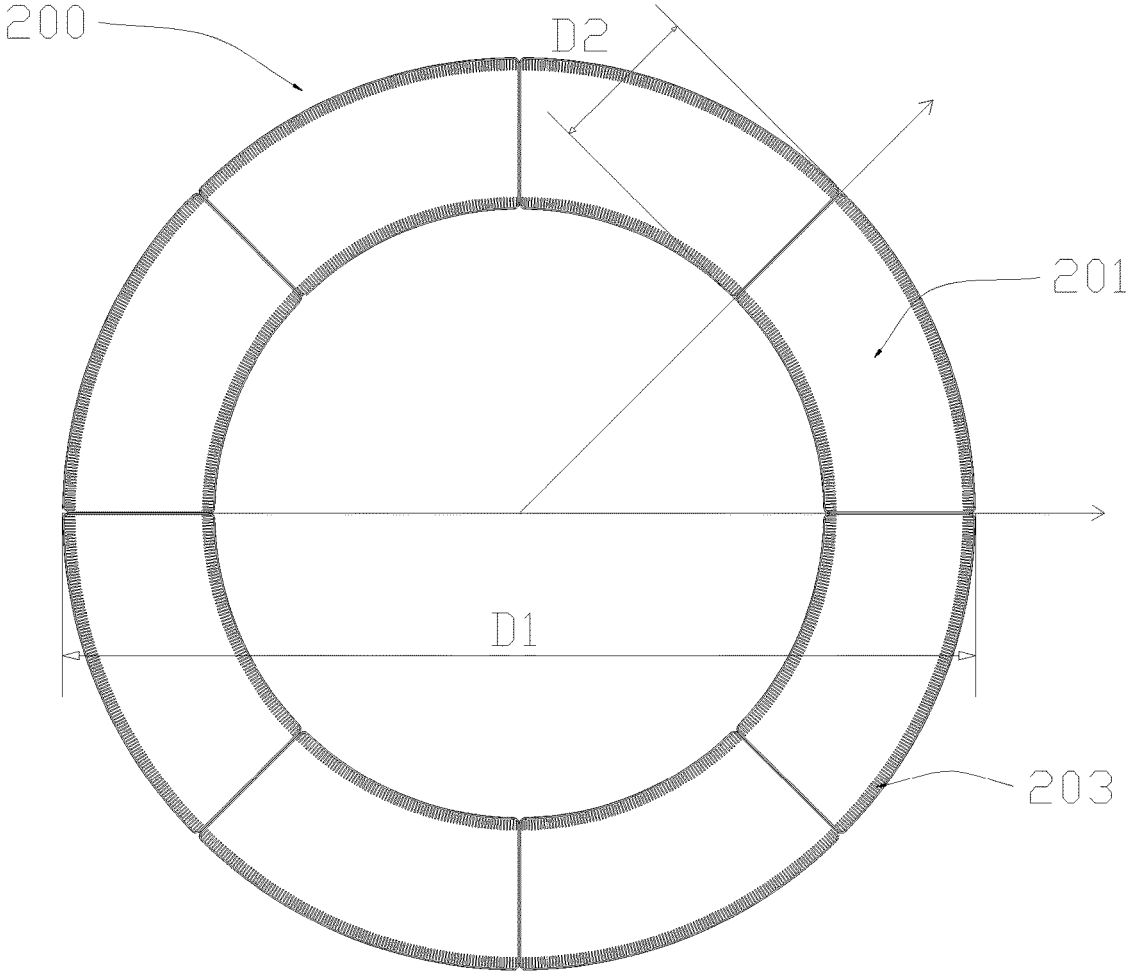
FIG. 11 is a top view of a building block according to the present disclosure.
Figure 12:
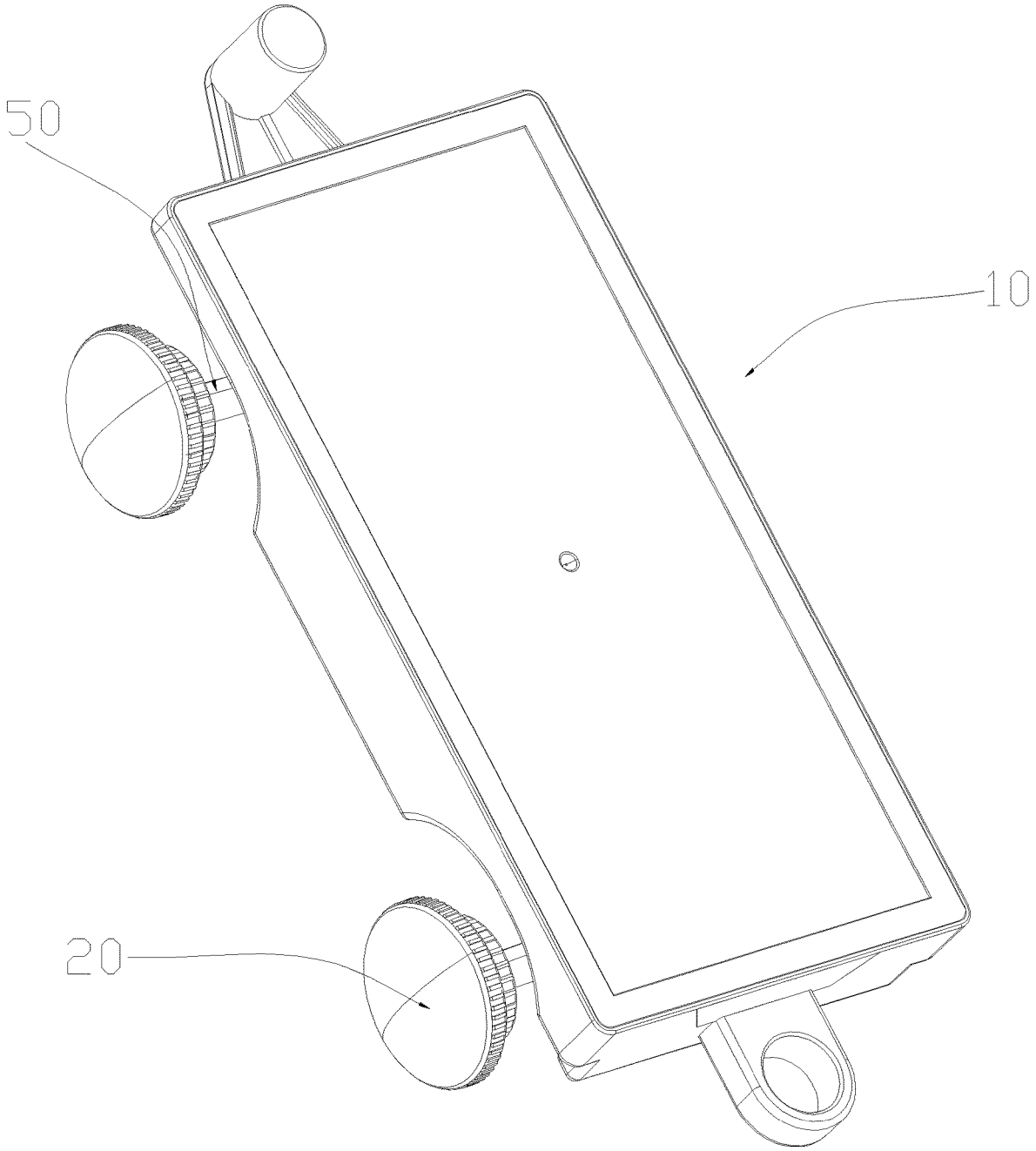
FIG. 12 is a schematic diagram of an entire structure of an angle of a first state of a manual toy car according to the present disclosure.
Figure 13:
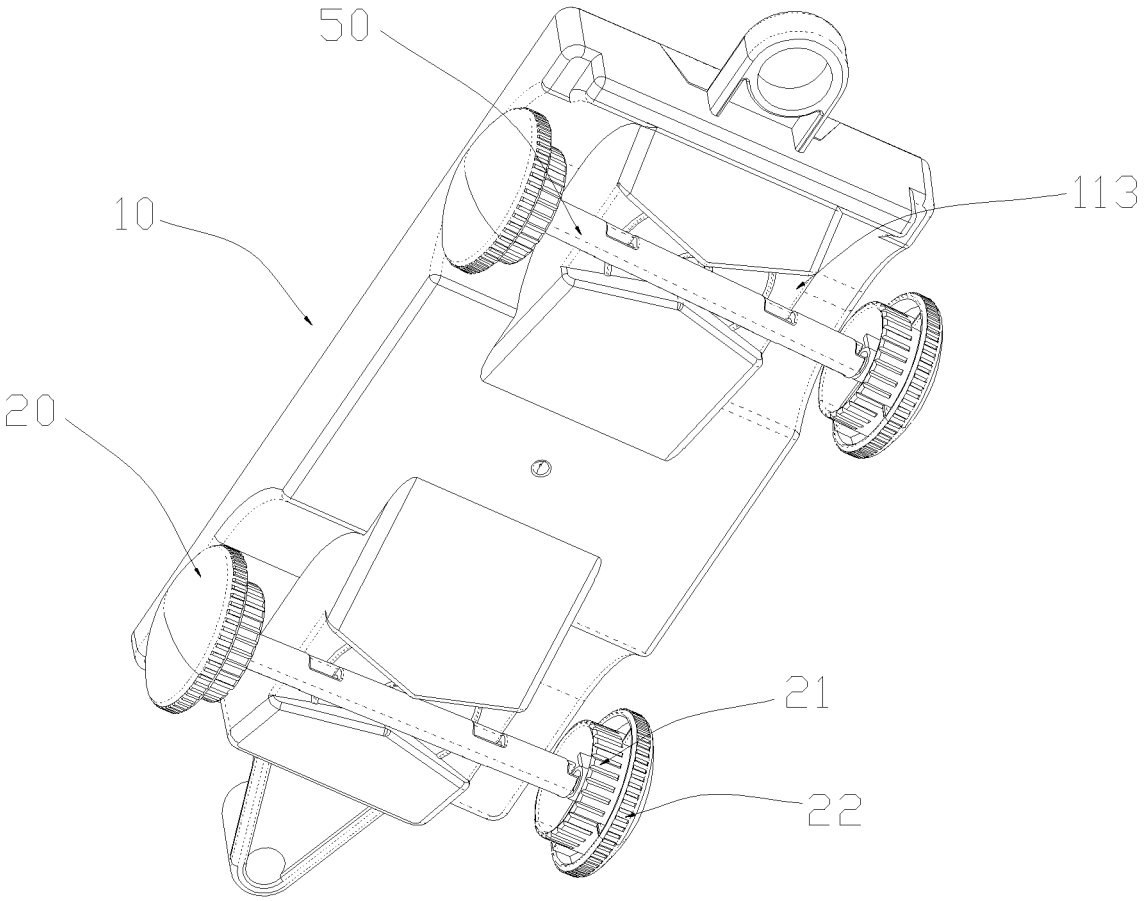
FIG. 13 is a schematic diagram of an entire structure of another angle of a first state of a manual toy car according to the present disclosure.
Figure 14:
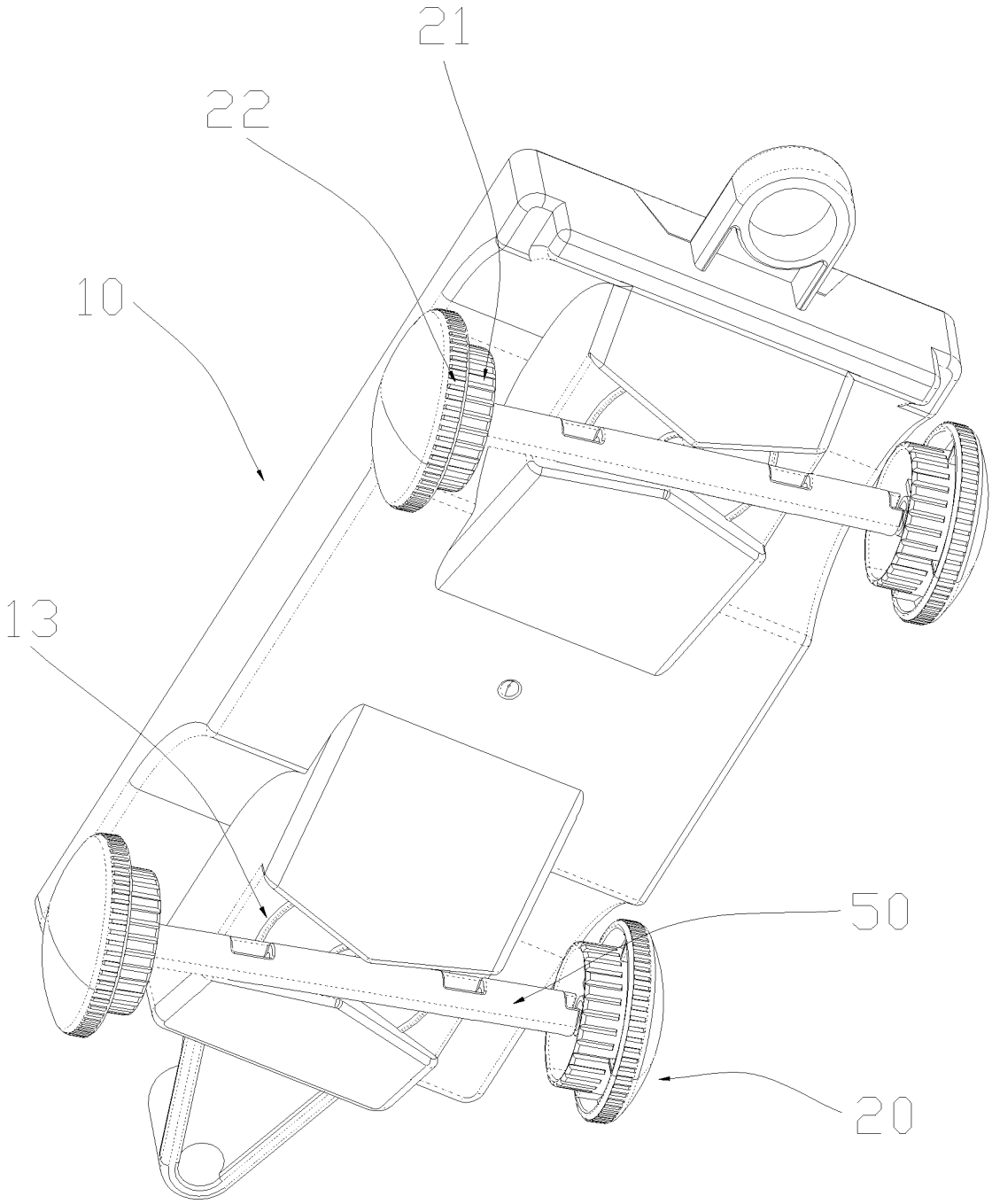
FIG. 14 is a schematic diagram of an entire structure of a second state of a manual toy car according to the present disclosure.
Figure 15:
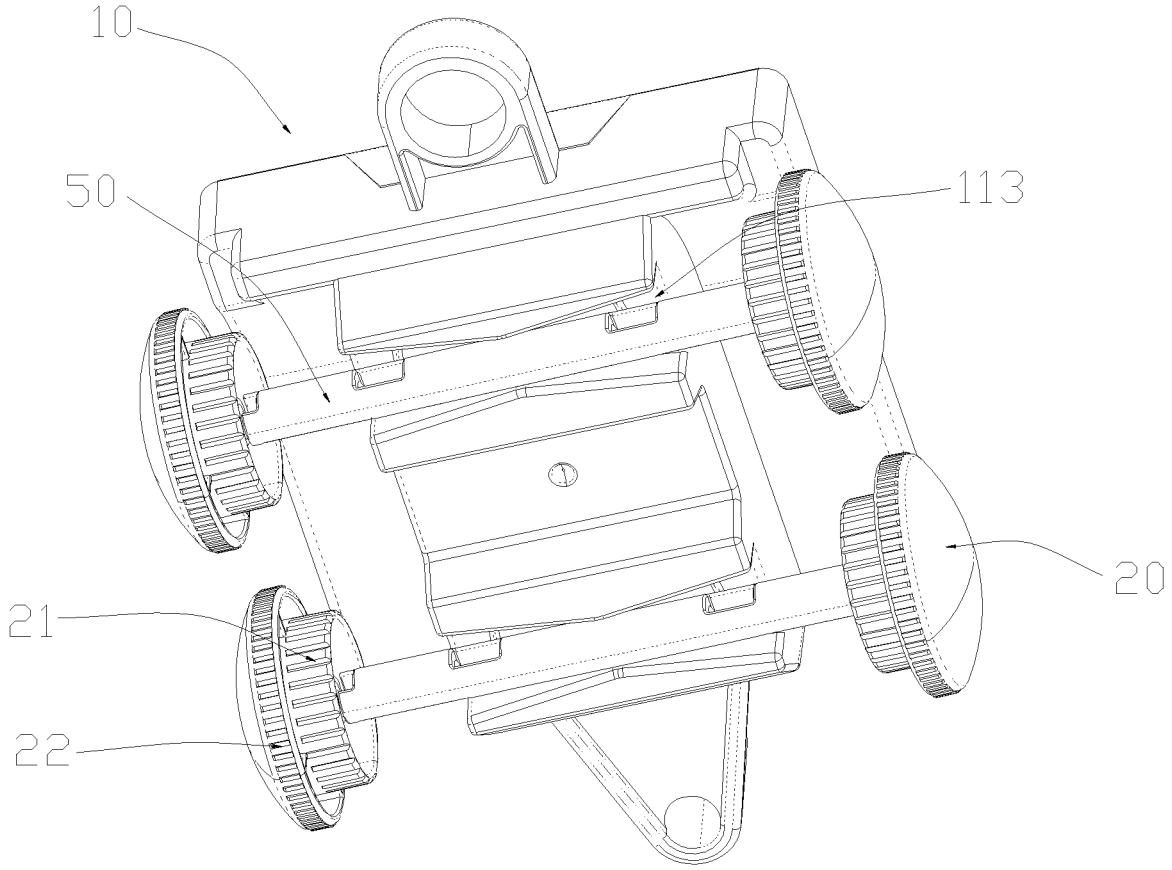
FIG. 15 is a schematic diagram of an entire structure of a first state of a manual toy car according to another embodiment of the present disclosure.

Referring to FIG. 1 to FIG. 18, a toy car includes:

a shell component 10, wherein the shell component 10 is provided with wheels 20 capable of rotating relative to the shell component 10;

wherein each of the wheels 20 includes a rolling part 21 and an abutting part 22; the abutting part 22 is arranged on one side of the rolling part 21 facing away from the shell component 10; the rolling part 21 is configured to be engaged to an upper surface 201 of a building block 200 and roll along the upper surface of the building block 200; and the abutting part 22 is configured to abut against a side surface 202 of the building block 200.

By the arrangement of the above structure, during use, the toy car 100 is placed on the building block 200, so that the rolling part 21 of the wheel 20 is combined with the upper surface 201 of the building block 200, and the abutting part 22 of the wheel 20 abuts against the side surface 202 of the building block 200. When the toy car 100 moves, the abutting part 22 of the wheel 20 always abuts against the side surface 202 of the building block 200, so that the toy car 100 can travel along an arrangement and extension direction of the building block 200. The rolling part 21 provides power for the toy car 100 to move forward through a friction force, and the abutting part 22 can always limit the toy car 100, so that the toy car 100 runs more stably.

In this embodiment, a surface of the rolling part 21 is provided with a friction pattern 211, and the friction pattern 211 is configured to be engaged to the upper surface of the building block 200 in a rubbing manner to push the toy car to move. By the arrangement of the above structure, the arrangement of the friction pattern 211 can further increase the friction force between the friction pattern 211 and the upper surface 201 of the building block 200. For a toy car with a power device, the toy car 100 can move along the surface of the building block 200 more easily, and a product runs more smoothly.

Figure 16:
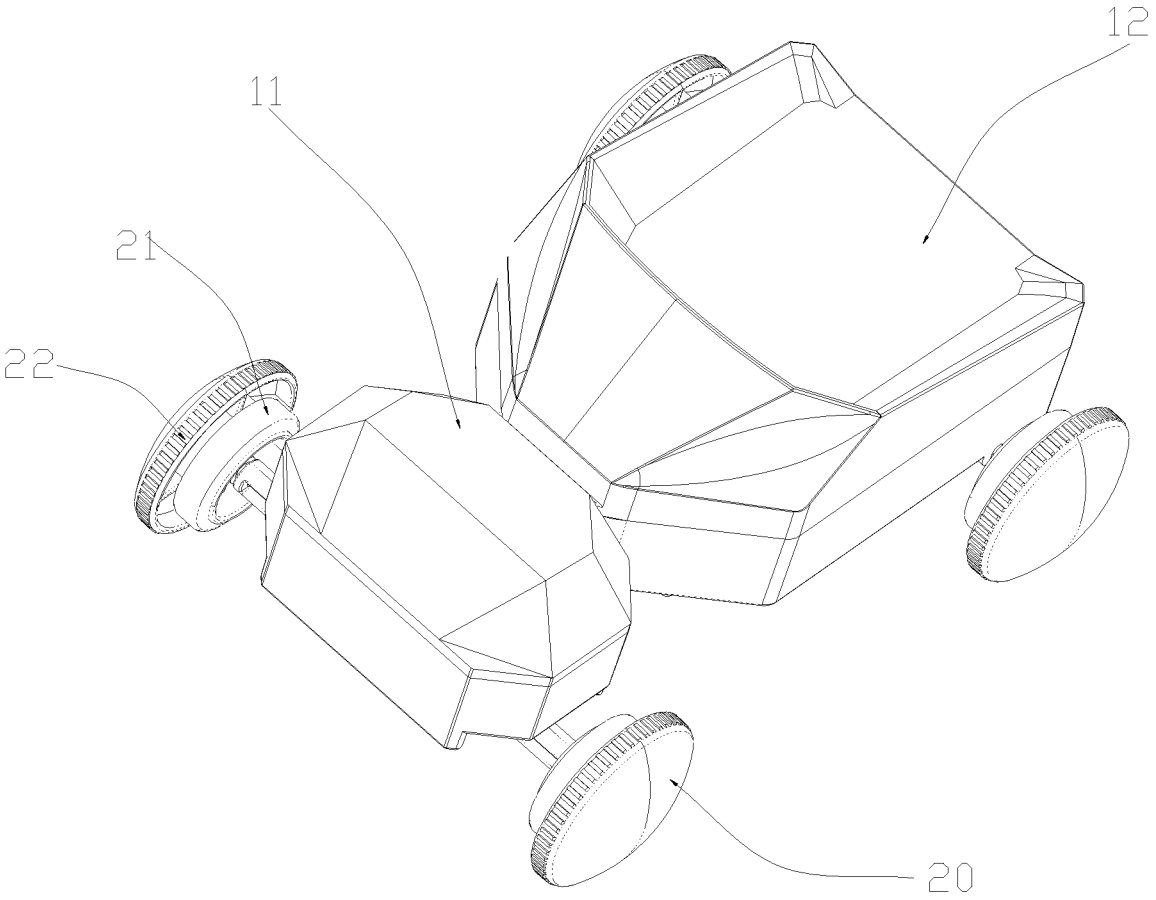
FIG. 16 is a schematic diagram of an entire structure of another angle of a first state according to another embodiment the present disclosure.

In an embodiment, referring to FIG. 16, a surface of the rolling part 21 is a smooth plane to reduce a friction force between the rolling part 21 and the upper surface 201 of the building block 200. During use, if the toy car does not have a power device, a user can manually push the toy car, or place the toy car on a tilted position, and the toy car slides on the building block by virtue of the gravity. At this time, the smooth plane can reduce the friction force between the surface of the rolling part 21 and the upper surface 201 of the building block 200, so that the toy car moves more smoothly on the building block 200, and the fun of the product is increased.

Figure 17:
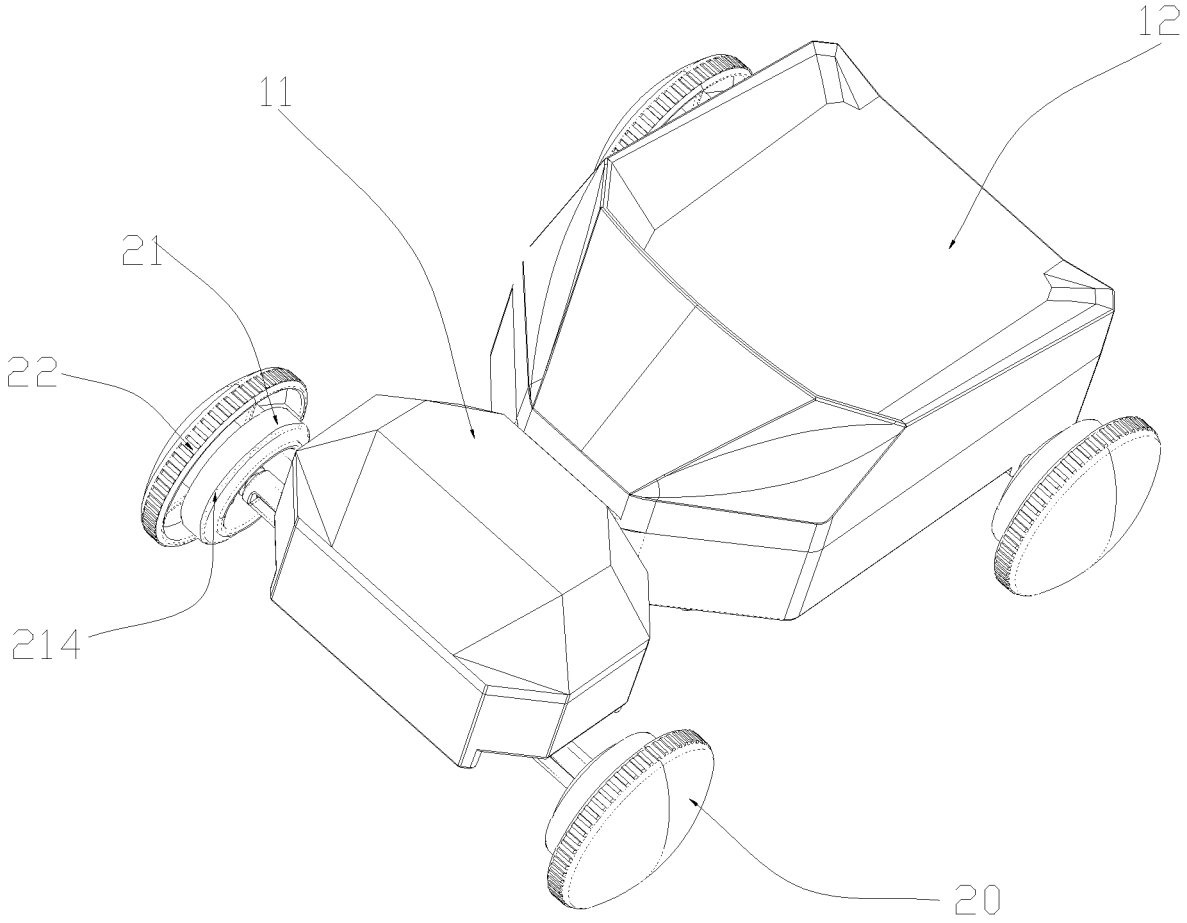
FIG. 17 is a schematic diagram of an entire structure of another angle of a first state according to another embodiment the present disclosure.

In an embodiment, referring to FIG. 17, a surface of the rolling part 21 is further provided with a rubber ring 214, and the rubber ring is engaged to the upper surface of the building block 200 in a rubbing manner to push the toy car to move. Preferably, for the toy car with the power device, the rubber ring can be added to the surface of the rolling part 21. As the rubber ring has a higher friction coefficient on a surface, the surface of the rolling part 21 is engaged to the upper surface 201 of the building block 200 more stably. Further, the rubber ring can be engaged with the friction pattern, that is, the rubber ring is arranged on the surface of the rolling part 21, and the friction pattern is added on the surface of the rubber ring, which can further increase the friction force. Preferably, a portion of the building block 200 that is engaged with the friction pattern 211 is further provided with a friction part 204, which can further increase the friction force between the rolling part 21 and the upper surface 201 of the building block 200.

In this embodiment, the rolling part 21 is provided with a first magnetic suction member 212; the first magnetic suction member 212 is configured to generate a magnetic suction force with a second magnetic suction member 203 inside the building block 200 to make the surface of the rolling part 21 tightly abut against the upper surface 201 of the building block 200. By the arrangement of the above structure, when the toy car 100 is placed on the upper surface 201 of the building block 200, the first magnetic suction member 212 is configured to generate the magnetic suction force with the second magnetic suction member 203 inside the building block 200, which increases a pressure Fn between the rolling part 21 and the upper surface 201 of the building block 200. It can be known according to a friction force formula $f=\mu\times Fn$ that if the pressure Fn increases, the friction force between the rolling part 21 and the upper surface 201 of the building block 200 can be further increased. This further facilitates the toy car 100 to move along the upper surface 201 of the building block 200 and improves the running efficiency of the product.

In this embodiment, the wheels 20 are arranged opposite to each other in pairs; a distance between the abutting parts 22 of two of the opposite wheels 20 is configured to be matched with a width of the building block 200, with a range of 7.5 CM to 7.8 CM. By the arrangement of the above structure, the wheels 20 arranged opposite to each other in pairs can improve the stability of the product, making the center of gravity of the product more stable. Moreover, the distance between the abutting parts 22 of two of the opposite wheels 20 is configured to be matched with the width of the building block 200, which can allow the abutting parts 22 to stably abut against the side surface 202 of the building block 200. This can effectively limit a running direction of the toy car 100, so that the toy car 100 can travel in the arrangement and extension direction of the building block 200. A width standard of the existing building block 200 on the market is 7.5 CM, allowing for a certain tolerance to prevent an excessive constraining force between the abutting part and the side surface 202 of the building block 200. On the premise of ensuring a limiting effect, the toy car 100 can also be allowed to move in the extension direction of the building block, which ensures the stability of the product.

In this embodiment, a distance between the rolling parts 21 of two of the opposite wheels 20 ranges from 5.5 CM to 7.5 CM. By the arrangement of the above structure, the distance between the abutting parts 22 of two of the opposite wheels 20 is set to be 5.5 CM to 7.5 CM, and the distance between the abutting parts 22 of two of the opposite wheels 20 is set to be 7.5 CM to 7.8 CM, so that the toy car can adapt to most building blocks 200. Furthermore, the narrower widths of the rolling parts 21 can allow the toy car 100 to turn more easily. Moreover, some of the existing building blocks 200 will have a window in the middle, so that the narrower abutting parts 22 can be stably combined with a framework at an edge of the window.

In this embodiment, the toy car further includes a driving device 30, wherein the shell component 10 is provided with an accommodating chamber 13; the driving device 30 is arranged in the accommodating chamber 13; and the driving device 30 drives the wheels 20 to rotate. By the arrangement of the above structure, the driving device 30 can drive the wheels 20 to rotate, so that the toy car 100 can automatically move on a surface of the building block 200, which releases the hands of the user and increase the fun of the product. The driving device 30 is arranged in the accommodating chamber 13, so that the driving device 30 can be effectively protected and hidden. This further improves the stability and attractiveness of the product.

In this embodiment, the toy car further includes a transmission component 40. The transmission component 40 is arranged in the accommodating chamber 13. The driving device 30 drives the transmission component 40, and the transmission component 40 drives the wheels to rotate. By the arrangement of the above structure, the transmission component can connect the driving device 30 to the wheels 20, making transmission more convenient. In addition, by use of gears with different ratios, a transmission ratio can also be changed, thereby changing a travel speed of the toy car 100.

In this embodiment, the shell component 10 includes a car head body 11 shell and a car body shell 12; and the car head shell 11 is rotatably connected to the car body shell 12. The car head shell 11 and the car body shell 12 rotatably cooperate with each other. During use, if the extension direction of the building block 200 changes, the abutting part 22 of the wheel 20 arranged on the car head shell 11 abuts against the side surface of the building block 200, forcing the wheel 20 arranged on the car head shell 11 and the car head shell 11 to turn. This can achieve the turning of the toy car 100, so that the toy car 100 can adapt to building blocks 200 with more shapes, and the toy car 100 can be allowed to move in the extension direction of the building block to ensure the stability of the product.

In this embodiment, the car head shell 11 is provided with a first connecting part 111; the car body shell 12 is provided with a second connecting part 121; and the first connecting part 111 is detachably connected to the second connecting part 121. By the arrangement of the above structure, the detachable first connecting part 111 and the detachable second connecting part 121 can allow the user to mount, remove, and replace the car head shell 11 or the car body shell 12. When a shell is damaged or contaminated, the user can replace it freely to prolong the service life of the product. Or, the user can be allowed to combine different car head shells 11 with the car body shell 12 to create more types of toy cars. This increases the fun of the product.

In this embodiment, the toy car further includes a bearing component 50; two ends of the bearing component 50 are connected to the wheels 20; a bottom of the shell component 10 is provided with a limiting slot 113; the bearing component 50 is rotatably connected to the shell component 10; and the limiting slot 113 is configured to allow the bearing component 50 to rotate for use. By the arrangement of the above structure, the bearing component 50 is rotatably connected to the shell component 10, allowing the bearing component 50 to rotate relative to the wheels of shell component 10 and achieving the turning of the toy car. The limiting slot 113 can limit a rotation angle of the bearing component 50 to prevent an excessive rotation angle of the bearing component 50 from hindering the travel of the toy car 100. This ensures the stability of the product.

In this embodiment, the bearing component 50 includes a connecting shaft 51 and a connecting shaft shell 52; the connecting shaft 51 is rotatably arranged on the connecting shaft shell 52; two ends of the connecting shaft 51 are connected to the wheels 20; the rotating shaft shell 52 is provided with a rotating part 521; a bottom of the car head shell 11 is provided with a rotating hole 112; and the rotating part 521 is rotatably inserted into the rotating hole 112. By the arrangement of the above structure, if the extension direction of the building block 200 changes during use, the abutting part 22 of the wheel 20 arranged on the car head shell 11 abuts against the side surface of the building block 200, forcing the wheel 20 arranged on the car head shell 11 to rotate, thereby driving the connecting shaft shell 52 to rotate and the car head shell 11 to turn. This further facilitates the toy car 100 to turn.

Figure 18:
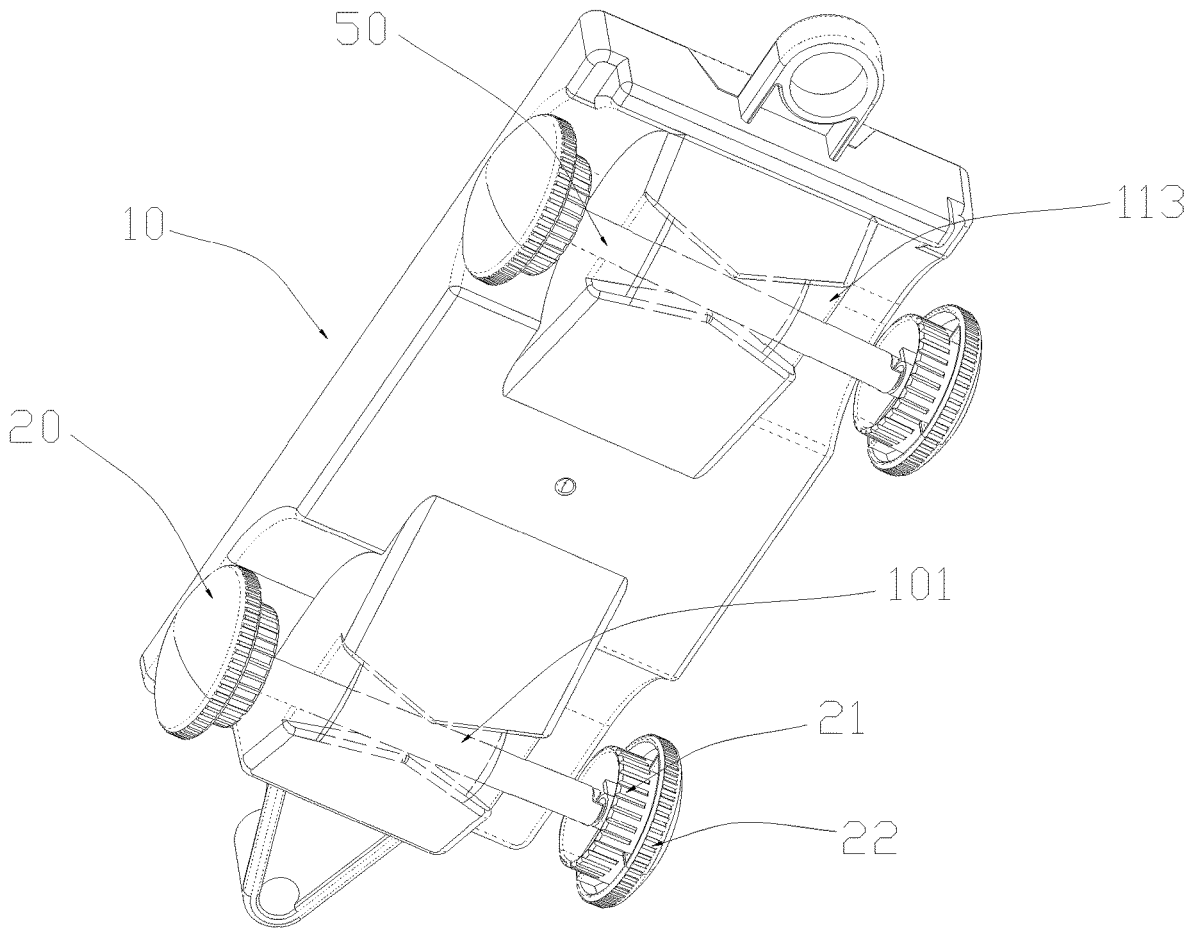
FIG. 18 is a schematic diagram of an entire structure of another angle of a first state according to another embodiment the present disclosure.

In an embodiment, referring to FIG. 18, the limiting slot 113 is further covered with a limiting plate 101 connected to the bottom of the shell component 10, and the limiting plate 101 limits the bearing component 50 in the limiting slot 113. By the arrangement of the above structure, during use, the limiting plate 101 limits the bearing assembly 50 in the limiting slot 113, so that when the extension direction of the building block 200 changes, the bearing assembly 50 will be limited to rotate in the limiting slot 113, thereby changing the direction of the wheel 20 of the car head shell 11 and effectively achieving the turning of the toy car 100.

In this embodiment, a width of the limiting slot 113 gradually increases from a middle part towards two ends, and the bearing component 50 is rotatably connected to the middle part. Specifically, the limiting slot 113 includes two slot side walls 1131 arranged at an angle, and the angle between the two slot side walls 1131 ranges from 5 degrees to 60 degrees. By the arrangement of the above structure, the bearing component 50 rotates inside the limiting slot 113 by taking the middle part of the limiting slot 113 as a pivot within the range of 5 degrees to 60 degrees, thereby achieving the rotation of the bearing component 50 at the angle ranging from 5 degrees to 60 degrees in the limiting slot 113. Thus, the direction of the wheel 20 of the car head shell 11 is driven to change, which effectively achieves the turning of the toy car 100.

In this embodiment, the toy car further includes a battery 60. The battery 60 is electrically connected to the driving device 30 and supplies power to the driving device 30. By the arrangement of the above structure, power can be effectively supplied to the driving device 30 to improve the endurance capability of the product. Further, the battery can be a rechargeable battery or a replaceable battery, which can further improve the endurance capability of the product.

In this embodiment, the car head shell 11 includes a car head base 1111 and a car head upper cover 1112. The car head upper cover 1112 is detachably covered at the car head base 1111. The car body shell 12 includes a car body base 1211, a car body upper cover 1212, and a fixed cover body 1213. The car body upper cover 1212 is detachably covered at the car body base 1211, and the fixed cover body 1213 is arranged between the car body upper cover 1212 and the car body base 1211. The car head upper cover 1112 is detachably covered at the car head base 1111, and the car body upper cover 1212 is detachably covered at the car body base 1211, so that the user can be allowed to freely replace different car head upper covers 1112 and/or car body upper covers 1212, and the user can individually combine the product to improve the appearance of the product. The fixed cover body 1213 can stably fix the driving device 30, the transmission component 40, and the battery 60 in the accommodating chamber 13, so as to improve the stability of the product.

Referring to FIG. 1 to FIG. 10, a toy car system includes:

a building block 200, wherein the building block 200 has an upper surface 201 and a side surface 202; and a toy car 100, wherein the toy car includes a shell component 10 and wheels 20 arranged on the shell component 10 and capable of rotating relative to the shell component 10;

wherein each of the wheels 20 includes a rolling part 21 and an abutting part 22; the abutting part 22 is arranged on one side of the rolling part 21 facing away from the shell component 10; the rolling part 21 is engaged to the upper surface 201 of the building block 200 and rolls along the upper surface 201 of the building block 200; and the abutting part 22 abuts against the side surface 202 of the building block 200.

By the arrangement of the above structure, during use, the toy car 100 is placed on the building block 200, so that the rolling part 21 of the wheel 20 is combined with the upper surface 201 of the building block 200, and the abutting part 22 of the wheel 20 abuts against the side surface 202 of the building block 200. When the toy car 100 moves, the abutting part 22 of the wheel 20 always abuts against the side surface 202 of the building block 200, so that the toy car 100 can travel along an arrangement and extension direction of the building block 200. The rolling part 21 provides power for the toy car 100 to move forward through a friction force, and the abutting part 22 can always limit the toy car 100, so that the toy car 100 runs more stably.

In this embodiment, the building block 200 includes a fan-shaped building block. A diameter of a circle where an edge of the fan-shaped building block is located is "D1", a width of the fan-shaped building block is "D2", and a ratio of D2 to D1 is 5.5 to 6.5. By the arrangement of the fan-shaped building block, the toy car can move along the fan-shaped building block, which achieves the turning of the toy car. Moreover, the ratio of D2 to D1 is 5.5 to 6.5, so that the toy car moves smoothly along the fan-shaped building block, thereby achieving the turning of the toy car. This prevents the toy car from being separated from the fan-shaped building block, and the product is used more conveniently and stably. If the ratio of D2 to D1 is too small, a curvature of the edge of the fan-shaped building block is too large, so that when the toy car turns along the fan-shaped building block, it is easy for the toy car to be separated from the fan-shaped building block or get stuck. However, if the ratio of D2 to D1 is too small, the curvature of the edge of the fan-shaped building block is too small, and the same turning angle needs to be achieved by a longer fan-shaped building block, so that the volume of the fan-shaped building block is too large, making it inconvenient to use and causing low turning efficiency.

In this embodiment, a surface of the rolling part 21 is provided with a friction pattern 211, and the friction pattern 211 is engaged to the upper surface 201 of the building block 200 in a rubbing manner to push the toy car to move. The upper surface 201 of the building block 200 is a plane. By the arrangement of the above structure, the arrangement of the friction pattern 211 can further increase the friction force between the friction pattern 211 and the upper surface 201 of the building block 200. For a toy car with a power device, the toy car 100 can move along the surface of the building block 200 more easily, and a product runs more smoothly.

In an embodiment, referring to FIG. 16, a surface of the rolling part 21 is a smooth plane to reduce a friction force between the rolling part 21 and the upper surface 201 of the building block 200. During use, if the toy car does not have a power device, a user can manually push the toy car, or place the toy car on a tilted position, and the toy car slides on the building block by virtue of the gravity. At this time, the smooth plane can reduce the friction force between the surface of the rolling part 21 and the upper surface 201 of the building block 200, so that the toy car moves more smoothly on the building block 200, and the fun of the product is increased.

In an embodiment, referring to FIG. 17, a surface of the rolling part 21 is further provided with a rubber ring, and the rubber ring is engaged to the upper surface of the building block 200 in a rubbing manner to push the toy car to move. Preferably, for the toy car with the power device, the rubber ring can be added to the surface of the rolling part 21. As the rubber ring has a higher friction coefficient on a surface, the surface of the rolling part 21 is engaged to the upper surface 201 of the building block 200 more stably. Further, the rubber ring can be engaged with the friction pattern, that is, the rubber ring is arranged on the surface of the rolling part 21, and the friction pattern is added on the surface of the rubber ring, which can further increase the friction force. Preferably, a portion of the building block 200 that is engaged with the friction pattern 211 is further provided with a friction part 204, which can further increase the friction force between the rolling part 21 and the upper surface 201 of the building block 200.

In this embodiment, the rolling part 21 is provided with a first magnetic suction member 212; a second magnetic suction member 203 is arranged in the building block 200; a magnetic suction force is generated between the first magnetic suction member 212 and the second magnetic suction member 203, so that the surface of the rolling part 21 tightly abuts against the upper surface 201 of the building block 200. By the arrangement of the above structure, when the toy car 100 is placed on the upper surface 201 of the building block 200, the first magnetic suction member 212 is configured to generate the magnetic suction force with the second magnetic suction member 203 inside the building block 200, which increases a pressure Fn between the rolling part 21 and the upper surface 201 of the building block 200. It can be known according to a friction force formula $f=\mu\times Fn$ that if the pressure Fn increases, the friction force between the rolling part 21 and the upper surface 201 of the building block 200 can be further increased. This further facilitates the toy car 100 to move along the upper surface 201 of the building block 200 and improves the running efficiency of the product.

In this embodiment, the wheels 20 are arranged opposite to each other in pairs; a distance between the abutting parts 22 of two of the opposite wheels 20 is matched with a width of the building block 200, with a range of 7.5 CM to 7.8 CM. By the arrangement of the above structure, the wheels 20 arranged opposite to each other in pairs can improve the stability of the product, making the center of gravity of the product more stable. Moreover, the distance between the abutting parts 22 of two of the opposite wheels 20 is configured to be matched with the width of the building block 200, which can allow the abutting parts 22 to stably abut against the side surface 202 of the building block 200. This can effectively limit a running direction of the toy car 100, so that the toy car 100 can travel in the arrangement and extension direction of the building block 200. A width standard of the existing building block 200 on the market is 7.5 CM, allowing for a certain tolerance to prevent an excessive constraining force between the abutting part and the side surface 202 of the building block 200. On the premise of ensuring a limiting effect, the toy car 100 can also be allowed to move in the extension direction of the building block, which ensures the stability of the product.

In this embodiment, a distance between the rolling parts 21 of two of the opposite wheels 20 ranges from 5.5 CM to 7.5 CM. By the arrangement of the above structure, the distance between the abutting parts 22 of two of the opposite wheels 20 is set to be 5.5 CM to 7.5 CM, and the distance between the abutting parts 22 of two of the opposite wheels 20 is set to be 7.5 CM to 7.8 CM, so that the toy car can adapt to most building blocks 200. Furthermore, the narrower widths of the rolling parts 21 can allow the toy car 100 to turn more easily. Moreover, some of the existing building blocks 200 will have a window in the middle, so that the narrower abutting parts 22 can be stably combined with a framework at an edge of the window.

In this embodiment, the toy car further includes a driving device 30, wherein the shell component 10 is provided with an accommodating chamber 13; the driving device 30 is arranged in the accommodating chamber 13; and the driving device 30 drives the wheels 20 to rotate. By the arrangement of the above structure, the driving device 30 can drive the wheels 20 to rotate, so that the toy car 100 can automatically move on a surface of the building block 200, which releases the hands of the user and increase the fun of the product. The driving device 30 is arranged in the accommodating chamber 13, so that the driving device 30 can be effectively protected and hidden. This further improves the stability and attractiveness of the product.

In this embodiment, the toy car further includes a transmission component 40. The transmission component 40 is arranged in the accommodating chamber 13. The driving device 30 drives the transmission component 40, and the transmission component 40 drives the wheels to rotate. By the arrangement of the above structure, the transmission component can connect the driving device 30 to the wheels 20, making transmission more convenient. In addition, by use of gears with different ratios, a transmission ratio can also be changed, thereby changing a travel speed of the toy car 100.

In this embodiment, the shell component 10 includes a car head body 11 shell and a car body shell 12; and the car head shell 11 is rotatably connected to the car body shell 12. The car head shell 11 and the car body shell 12 rotatably cooperate with each other. During use, if the extension direction of the building block 200 changes, the abutting part 22 of the wheel 20 arranged on the car head shell 11 abuts against the side surface of the building block 200, forcing the wheel 20 arranged on the car head shell 11 and the car head shell 11 to turn. This can achieve the turning of the toy car 100, so that the toy car 100 can adapt to building blocks 200 with more shapes, and the toy car 100 can be allowed to move in the extension direction of the building block to ensure the stability of the product.

In this embodiment, the car head shell 11 is provided with a first connecting part 111; the car body shell 12 is provided with a second connecting part; and the first connecting part 111 is detachably connected to the second connecting part 121. By the arrangement of the above structure, the detachable first connecting part 111 and the detachable second connecting part 121 can allow the user to mount, remove, and replace the car head shell 11 or the car body shell 12. When a shell is damaged or contaminated, the user can replace it freely to prolong the service life of the product. Or, the user can be allowed to combine different car head shells 11 with the car body shell 12 to create more types of toy cars. This increases the fun of the product.

In this embodiment, the toy car further includes a bearing component 50; two ends of the bearing component 50 are connected to the wheels 20; a bottom of the shell component 10 is provided with a limiting slot 113; the bearing component 50 is rotatably connected to the shell component 10; and the limiting slot 113 is configured to allow the bearing component 50 to rotate for use. By the arrangement of the above structure, the bearing component 50 is rotatably connected to the shell component 10, allowing the bearing component 50 to rotate relative to the wheels of shell component 10 and achieving the turning of the toy car. The limiting slot 113 can limit a rotation angle of the bearing component 50 to prevent an excessive rotation angle of the bearing component 50 from hindering the travel of the toy car 100. This ensures the stability of the product.

In this embodiment, the bearing component 50 includes a connecting shaft 51 and a connecting shaft shell 52; the connecting shaft 51 is rotatably arranged on the connecting shaft shell 52; two ends of the connecting shaft 51 are connected to the wheels 20; the rotating shaft shell 52 is provided with a rotating part 521; a bottom of the car head shell 11 is provided with a rotating hole 112; and the rotating part 521 is rotatably inserted into the rotating hole 112. By the arrangement of the above structure, if the extension direction of the building block 200 changes during use, the abutting part 22 of the wheel 20 arranged on the car head shell 11 abuts against the side surface of the building block 200, forcing the wheel 20 arranged on the car head shell 11 to rotate, thereby driving the connecting shaft shell 52 to rotate and the car head shell 11 to turn. This further facilitates the toy car 100 to turn.

In an embodiment, referring to FIG. 18, the limiting slot 113 is further covered with a limiting plate 101 connected to the bottom of the shell component 10, and the limiting plate 101 limits the bearing component 50 in the limiting slot 113. By the arrangement of the above structure, during use, the limiting plate 101 limits the bearing assembly 50 in the limiting slot 113, so that when the extension direction of the building block 200 changes, the bearing assembly 50 will be limited to rotate in the limiting slot 113, thereby changing the direction of the wheel 20 of the car head shell 11 and effectively achieving the turning of the toy car 100.

In this embodiment, a width of the limiting slot 113 gradually increases from a middle part towards two ends, and the bearing component 50 is rotatably connected to the middle part. Specifically, the limiting slot 113 includes two slot side walls 1131 arranged at an angle; and the angle between the two slot side walls 1131 ranges from 5 degrees to 60 degrees. By the arrangement of the above structure, the bearing component 50 rotates inside the limiting slot 113 by taking the middle part of the limiting slot 113 as a pivot within the range of 5 degrees to 60 degrees, thereby achieving the rotation of the bearing component 50 at the angle ranging from 5 degrees to 60 degrees in the limiting slot 113. Thus, the direction of the wheel 20 of the car head shell 11 is driven to change, which effectively achieves the turning of the toy car 100.

In this embodiment, the toy car further includes a battery 60. The battery 60 is electrically connected to the driving device 30 and supplies power to the driving device 30. By the arrangement of the above structure, power can be effectively supplied to the driving device 30 to improve the endurance capability of the product. Further, the battery can be a rechargeable battery or a replaceable battery, which can further improve the endurance capability of the product.

In this embodiment, the car head shell 11 includes a car head base 1111 and a car head upper cover 1112. The car head upper cover 1112 is detachably covered at the car head base 1111. The car body shell 12 includes a car body base 1211, a car body upper cover 1212, and a fixed cover body 1213. The car body upper cover 1212 is detachably covered at the car body base 1211, and the fixed cover body 1213 is arranged between the car body upper cover 1212 and the car body base 1211. The car head upper cover 1112 is detachably covered at the car head base 1111, and the car body upper cover 1212 is detachably covered at the car body base 1211, so that the user can be allowed to freely replace different car head upper covers 1112 and/or car body upper covers 1212, and the user can individually combine the product to improve the appearance of the product. The fixed cover body 1213 can stably fix the driving device 30, the transmission component 40, and the battery 60 in the accommodating chamber 13, so as to improve the stability of the product.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A toy car, comprising:

a shell component, wherein the shell component is provided with wheels capable of rotating relative to the shell component;

wherein each of the wheels comprises a rolling part and an abutting part; the abutting part is arranged on one side of the rolling part facing away from the shell component; the rolling part is configured to be engaged to an upper surface of a building block and roll along the upper surface of the building block; and the abutting part is configured to abut against a side surface of the building block;

wherein the toy car further comprises a bearing component, two ends of the bearing component are connected to the wheels; a bottom of the shell component is provided with a limiting slot; the bearing component is rotatably connected to the shell component; and the limiting slot is configured to allow the bearing component to rotate for use;

wherein the bearing component is received in the limiting slot;

wherein the toy car further comprises two slot side walls arranged at an angle, each of the two slot side walls is ">" shaped, and the two slot side walls cooperatively define the limiting slot;

wherein the limiting slot is X-shaped, and a width of the limiting slot gradually increases from a middle part towards two ends;

wherein a distance between the abutting parts of two of the opposite wheels is in a range of 7.5 CM to 7.8 CM; and a distance between the rolling parts of two of the opposite wheels ranges from 5.5 CM to 7.5 CM.

2. The toy car according to claim 1, wherein a surface of the rolling part is provided with a friction pattern, and the friction pattern is configured to be engaged to the upper surface of the building block in a rubbing manner to push the toy car to move.

3. The toy car according to claim 1, wherein a surface of the rolling part is a smooth plane to reduce a friction force between the rolling part and the upper surface of the building block.

4. The toy car according to claim 1, wherein a surface of the rolling part is further provided with a rubber ring, and the rubber ring is engaged to the upper surface of the building block in a rubbing manner to push the toy car to move.

5. The toy car according to claim 1, wherein the rolling part is provided with a first magnetic suction member; the first magnetic suction member is configured to generate a magnetic suction force with a second magnetic suction member inside the building block to make a surface of the rolling part tightly abut against the upper surface of the building block; the wheels are arranged opposite to each other in pairs; a distance between the abutting parts of two of the opposite wheels is configured to be matched with a width of the building block.

6. The toy car according to claim 1, further comprising a driving device, wherein the shell component is provided with an accommodating chamber; the driving device is arranged in the accommodating chamber; the driving device drives the wheels to rotate;

the shell component comprises a car head body shell and a car body shell; the car head body shell is rotatably connected to the car body shell;

the car head body shell is provided with a first connecting part;

the car body shell is provided with a second connecting part; and the first connecting part is detachably connected to the second connecting part.

7. The toy car according to claim 1, wherein the bearing component comprises a connecting shaft and a connecting shaft shell;

the connecting shaft is rotatably arranged on the connecting shaft shell; two ends of the connecting shaft are connected to the wheels;

the rotating shaft shell is provided with a rotating part;

a bottom of the car head body shell is provided with a rotating hole; and the rotating part is rotatably inserted into the rotating hole.

8. The toy car according to claim 1, wherein the limiting slot is further covered with a limiting plate connected to the bottom of the shell component, and the limiting plate limits the bearing component in the limiting slot.

9. The toy car according to claim 1, wherein the bearing component is rotatably connected to the middle part.

10. A toy car system, comprising:

a building block, wherein the building block has an upper surface and a side surface; and a toy car, wherein the toy car comprises a shell component and wheels arranged on the shell component and capable of rotating relative to the shell component;

wherein each of the wheels comprises a rolling part and an abutting part; the abutting part is arranged on one side of the rolling part facing away from the shell component; the rolling part is engaged to the upper surface of the building block and rolls along the upper surface of the building block; and the abutting part abuts against the side surface of the building block;

wherein the abutting part comprises an abutting surface for abutting against the side surface of the building block, and the abutting surface is perpendicular to the upper surface of the building block;

wherein the rolling part comprises a rolling surface, the rolling surface is directly connected to the abutting surface.

11. The toy car system according to claim 10, wherein a surface of the rolling part is provided with a friction pattern, and the friction pattern is engaged to the upper surface of the building block in a rubbing manner to push the toy car to move, wherein the upper surface of the building block is a plane.

12. The toy car system according to claim 10, wherein a surface of the rolling part is further provided with a rubber ring, and the rubber ring is engaged to the upper surface of the building block in a rubbing manner to push the toy car to move.

13. The toy car according to claim 10, wherein the rolling part is provided with a first magnetic suction member;

a second magnetic suction member is arranged in the building block;

a magnetic suction force is generated between the first magnetic suction member and the second magnetic suction member, so that a surface of the rolling part tightly abuts against the upper surface of the building block;

the wheels are arranged opposite to each other in pairs; a distance between the abutting parts of two of the opposite wheels is matched with a width of the building block, with a range of 7.5 CM to 7.8 CM;

a distance between the rolling parts of two of the opposite wheels ranges from 5.5 CM to 7.5 CM;

the shell component comprises a car head body shell and a car body shell;

the car head body shell is rotatably connected to the car body shell;

the car head body shell is provided with a first connecting part;

the car body shell is provided with a second connecting part; and the first connecting part is detachably connected to the second connecting part.

14. The toy car system according to claim 13, further comprising a bearing component, wherein two ends of the bearing component are connected to the wheels; a bottom of the shell component is provided with a limiting slot; the bearing component is rotatably connected to the shell component; and the limiting slot is configured to allow the bearing component to rotate for use.

15. The toy car system according to claim 14, wherein the bearing component comprises:

a connecting shaft; and a connecting shaft shell; the connecting shaft is rotatably arranged on the connecting shaft shell;

two ends of the connecting shaft are connected to the wheels;

the rotating shaft shell is provided with a rotating part;

a bottom of the car head body shell is provided with a rotating hole; and the rotating part is rotatably inserted into the rotating hole.

16. The toy car system according to claim 10, wherein a shape of the abutting surface matches with that of the side surface of the building block.

17. A toy car system, comprising:

a building block, wherein the building block has an upper surface and a side surface; and a toy car, wherein the toy car comprises a shell component and wheels arranged on the shell component and capable of rotating relative to the shell component;

wherein each of the wheels comprises a rolling part and an abutting part; the abutting part is arranged on one side of the rolling part facing away from the shell component; the rolling part is engaged to the upper surface of the building block and rolls along the upper surface of the building block; and the abutting part abuts against the side surface of the building block;

wherein the upper surface of the building block is substantially flat, and there is no guide rail formed on the upper surface of the building block.

18. The toy car system according to claim 17, wherein a surface of the rolling part is provided with a friction pattern, and the friction pattern is engaged to the upper surface of the building block in a rubbing manner to push the toy car to move.

19. The toy car system according to claim 17, wherein a surface of the rolling part is a smooth plane to reduce a friction force between the rolling part and the upper surface of the building block.

20. The toy car system according to claim 17, wherein a surface of the rolling part is further provided with a rubber ring, and the rubber ring is engaged to the upper surface of the building block in a rubbing manner to push the toy car to move.

* * * * *